US005644991A

United States Patent [19]

Prévot et al.

[11] Patent Number: 5,644,991

[45] Date of Patent: Jul. 8, 1997

[54] TRANSPORT PALLET

[75] Inventors: Jean-Paul Prévot, Avrillé; Pascal Ricou, St-Georges S/Loire, both of France

[73] Assignee: Bull S.A., Louveciennes, France

[21] Appl. No.: 499,374

[22] Filed: Jul. 7, 1995

[30] Foreign Application Priority Data

Jul. 13, 1994 [FR] France ..... 94 08763

[51] Int. Cl.[6] ..... B65D 19/38

[52] U.S. Cl. ..... 108/54.1; 108/55.3

[58] Field of Search ..... 108/54.1, 55.1, 108/55.5, 56.3, 51.1, 56.5; 248/346.02, 346.03, 346.05, 501, 649, 669, 680, 637

[56] References Cited

U.S. PATENT DOCUMENTS

| | | | |
|---|---|---|---|
| 1,104,891 | 7/1914 | Heusser | 248/346.05 |
| 1,129,775 | 2/1915 | Anthony | 108/54.1 X |
| 2,386,516 | 10/1945 | Thompson | 108/55.3 X |
| 3,375,795 | 4/1968 | Wagner | 108/55.3 X |
| 3,779,571 | 12/1973 | Ahmling . | |
| 3,949,878 | 4/1976 | Tuthill . | |
| 4,887,537 | 12/1989 | Kelogg | 108/55.1 |

FOREIGN PATENT DOCUMENTS

| | | | |
|---|---|---|---|
| 547276 | 5/1956 | Belgium . | |
| 788290 | 6/1968 | Canada | 108/54.1 |
| 2312477 | 9/1974 | Germany . | |
| 406074299 | 3/1994 | Japan | 248/637 |
| 1490021 | 6/1989 | U.S.S.R. | 108/54.1 |

*Primary Examiner*—Jose V. Chen

*Attorney, Agent, or Firm*—Kerkam, Stowell, Kondracki & Clarke, P.C.; Edward J. Kondracki

[57] ABSTRACT

A pallet for transporting a load having a deck and two skids removably mounted under the deck for supporting the deck and screw jacks which make it possible to vary the height of the deck relative to the ground. The deck is capable of supporting the weight of the load when it is carried by the screw jacks. Right angle brackets fasten the load to the deck. Depalletization consists of removing the skids by raising the deck via the screw jacks, then lowering the deck and moving the load in horizontal translation. The invention applies most particularly to the transport of heavy, bulky or fragile objects such as cabinets of data processing machines.

30 Claims, 3 Drawing Sheets

FIG. 2
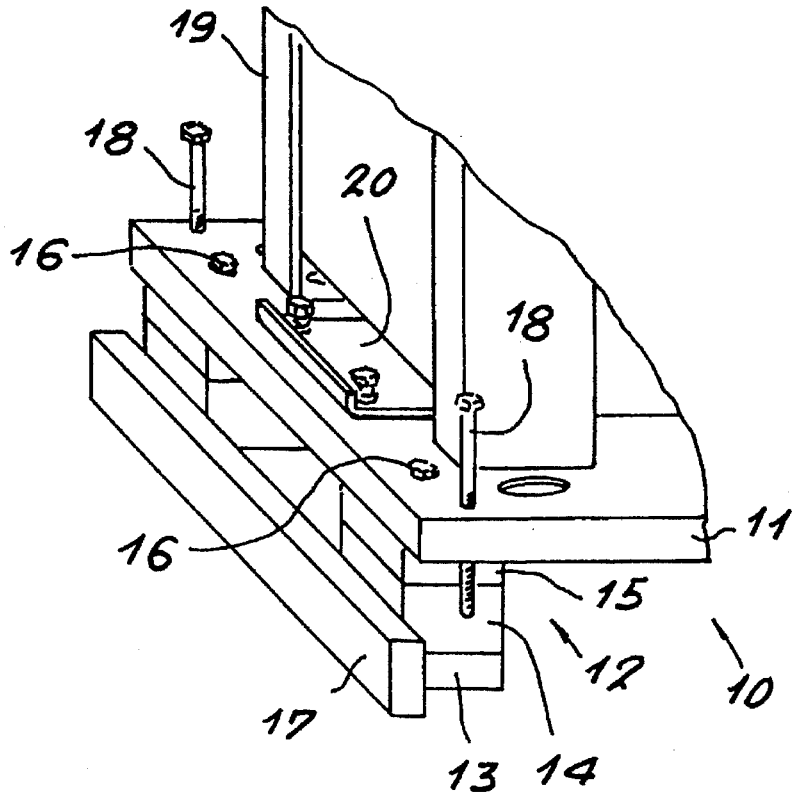
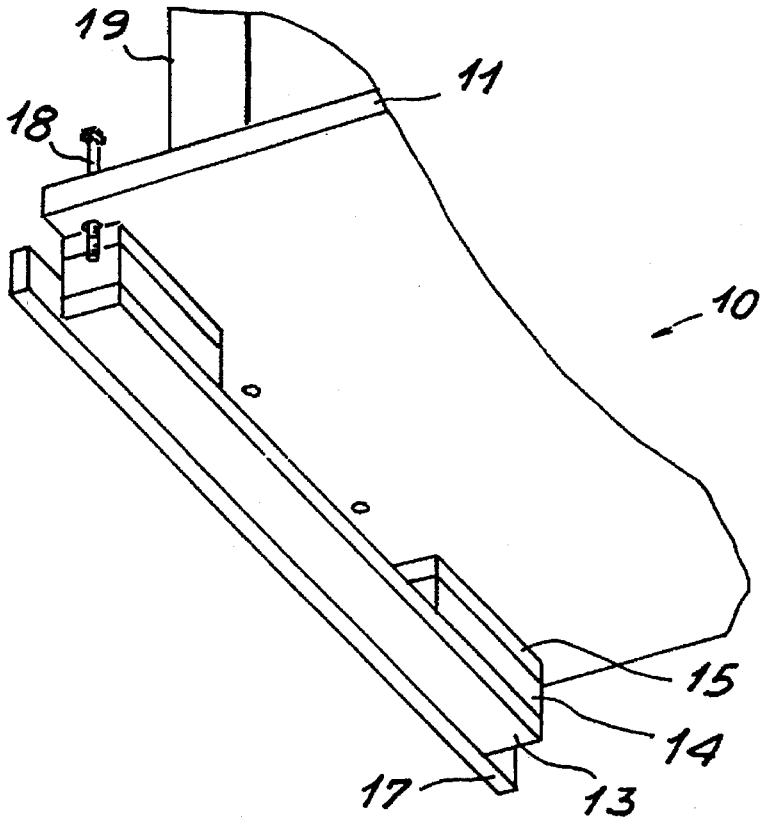
FIG. 3

TRANSPORT PALLET

BACKGROUND OF THE INVENTION

1. Field of the Invention

The invention relates to transport pallets particularly adapted to transporting heavy, bulky and fragile objects such as, for example, cabinets for processing electrical signals by means of integrated circuits. The invention applies particularly to pallets for transporting cabinets of data processing machines. Transportation ordinarily includes the operations of handling, transportation proper, and storage.

2. Description of the Related Art

An ordinary pallet is made from a load board which includes two decks connected to one another by deck spacers which allow the passage of lift-truck and pallet truck forks. The invention relates to non-reversible pallets with small load-bearing surfaces, intended for the specific uses mentioned above. Under these conditions, the lower deck forms a base and constitutes, along with the deck spacers, the means of support for the upper deck, which is simply called the deck. Thus, the deck and its means of support form a fixed, non-movable structure, which is of course capable of supporting the weight of the cabinet. When the load must be immobilized on the pallet, the pallet is provided with means for holding the load which form a collar or surrounding frame over the load. These means for holding the load are quite varied, and can be very sophisticated for specific uses.

Typical examples of prior art arrangements include U. S. Pat. Nos. 3,949,878 and 3,779,571; Belgium Patent 547,276 and German Patent 2,312,477.

Computer cabinets require very strict handling conditions which will emphasize the problems solved by the invention. First of all, these cabinets are very costly. They contain of electrical and electronic elements miniaturized to adapt to the very large scale integration of circuits in a semiconductor material, and to provide the shortest paths for very high frequency electrical signals. These components and their assembly are therefore fragile, and will not withstand intense shocks. They are also very sensitive to ambient conditions. For example, they must be protected from dust and kept in a dry atmosphere at a temperature which is not excessive. The cabinets are therefore packed in an impermeable sheath of strong plastic, which must be well protected in order to prevent its coming open during transport due to, for example, a lateral shock. Moreover, these cabinets are very heavy, on the order of 250 kg for average systems and more than 500 kg for very large multiprocessor information systems. Removing a cabinet from the pallet (depalletization) at its destination point thus poses many problems. The cabinet is released from the means for holding it on the pallet and placed on casters. This requires the involvement of several men, in order to have proper control of the movements of the cabinet on the very limited surface of the deck of the pallet, and to prevent shocks or overturning during the lowering of the cabinet. Rails to be used in lowering the cabinet are ordinarily supplied with the cabinet. However, considering the weight of the cabinet, it is necessary for these rails to be very resistant to bending and long enough to provide a slope which is not too steep, to avoid the risk of unbalancing the cabinet. The rails are therefore made of thick steel and constitute very heavy and bulky elements which must accompany the cabinet. The problems posed by the transport of these cabinets are therefore numerous and very constraining. Moreover, although they are fragile, their weights and volumes require them to be transported with large trucks, and persons charged with the handling of heavy equipment, such as machine-tools and the much more robust farming machines, are generally not very concerned with the precautions which must normally be taken for this kind of cabinet.

SUMMARY OF THE INVENTION

One of the objects of the invention is to protect the cabinet and its package against the shocks that are possible during transport. Another object is to facilitate the depalletization of the cabinet, while avoiding the use of rails. Yet another object is to attain both of the two preceding objects using means which are simple, not very bulky, easy to use and not very costly.

The subject of the invention is a pallet for transporting a load, which includes a deck and means for supporting the deck which include two skids, characterized in that the two skids are removably mounted under the deck and the means for supporting the deck include screw jacks which make it possible to vary the height of the deck relative to the ground, and the deck has a structure capable of supporting the weight of the load when it is carried by the screw jacks.

Another subject of the invention is a process for the depalletization of a load mounted on a pallet made of a deck which rests on skids, characterized in that it consists of releasing the skids by raising the deck, then lowering the deck and moving the load in horizontal translation.

The example of the pallet which will be described in reference to the appended drawings will make the characteristics and advantages of the invention clear. In the drawings:

BRIEF DESCRIPTION OF THE DRAWINGS

FIG. 2 an enlarged perspective view of a side of the pallet which illustrates in detail the structure of the means for supporting the pallet and the means for holding the cabinet on the pallet;

FIG. 3 is a perspective view from underneath the pallet which illustrates the structure of the means for supporting the pallet;

DESCRIPTION OF THE PREFERRED EMBODIMENTS

Figure 1:
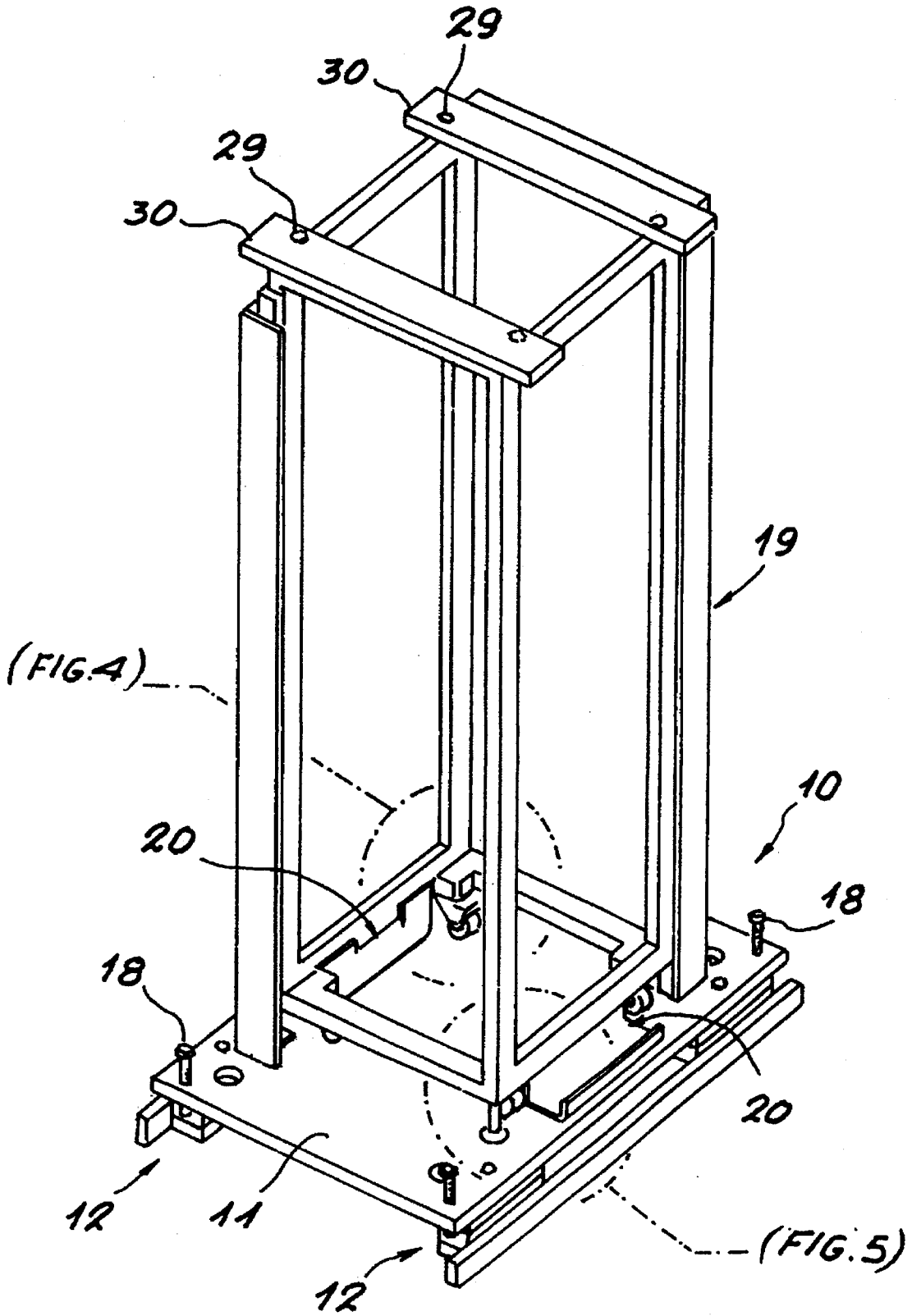
FIG. 1 is a perspective view of a pallet according to the invention for the transport of a computer cabinet, schematically represented by its frame.

The pallet 10 represented in FIG. 1 essentially includes a deck 11 equipped with support means formed by two lateral skids 12 removably mounted under the deck. Their spacing is arranged to allow the passage of lift-truck and pallet truck forks. In reference to FIGS. 2 and 3, each skid 12 is made of a base 13 which rests on the ground and spacers which constitute shock-absorbing means 14 and which, in this case, are constituted by two blocks of polyethylene foam located between the base 13 and the deck 11. The foam blocks 14 in the example illustrated are fastened to the end parts of the skid and have roughly the same width as the skid and the same height as one another in order to keep the plateau horizontal. In the example illustrated, the foam blocks 14 of each skid are inserted between the base 13 and two respective small upper boards 15 provided with means for fastening them removably to the deck 11, by screwing, for example. In the present case, the screwing is done by tap nuts in the small boards 15 at the level of the foam blocks 14 which correspond with holes drilled into the board for the passage of screws 16. The foam blocks 14 thus effectively absorb shocks with vertical components. In order for them to also effectively absorb shocks with horizontal components, a lateral board 17 is fastened to the base 13 and/or to the foam blocks 14, on the outside or on the inside, here nailed to the outside of the skid and glued to the foam blocks. It also extends beyond the length of the deck, in front and in back, for better absorption of longitudinal shocks.

The means for supporting the deck also include screw jacks 18 which make it possible to vary the height of the deck relative to the ground under conditions which will be described below. The screw jacks 18 illustrated are disposed in the four corners of the deck; each is made of a thick screw that turns inside a tap nut in the deck 11 and is potentially equipped with a foot at its bottom end. As illustrated in FIGS. 2 and 3, the screw jacks 18 are in the upper position, and do not support the deck when it rests normally on its two skids, so that these skids are fully in effect.

Figure 4:
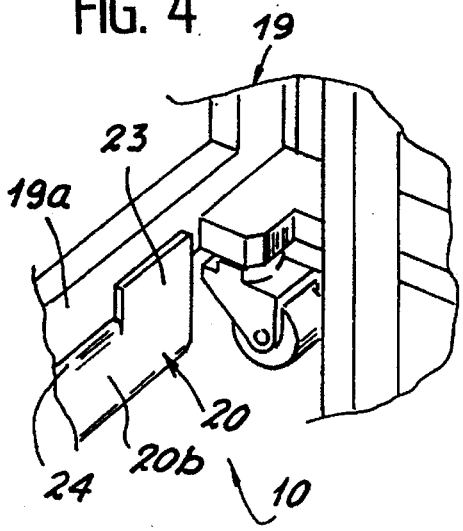
FIGS. 4 and 5 are views in perspective of the bottom parts of the cabinet represented in the respective circles in FIG. 1, to illustrate the details of the means for holding the cabinet on the pallet.
Figure 5:
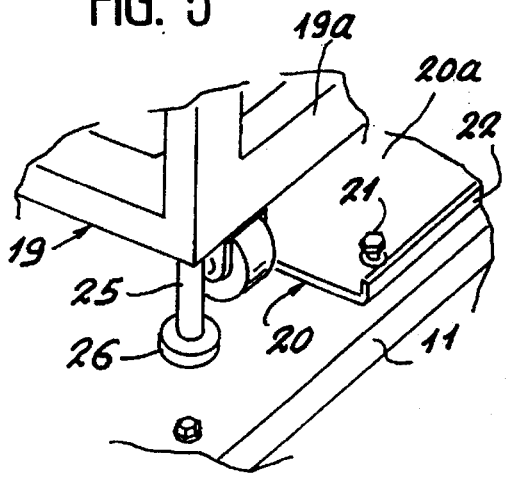
Figure 6:
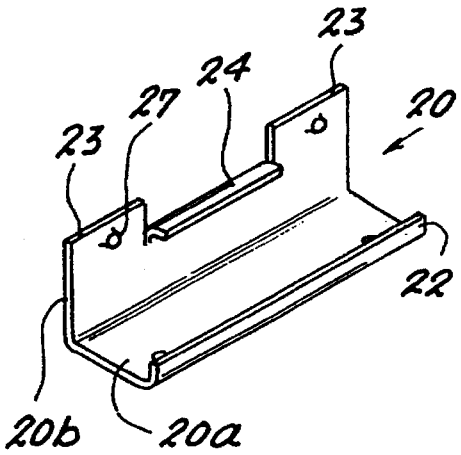
FIG. 6 is a perspective view of a bracket for holding the cabinet.
Figure 7:
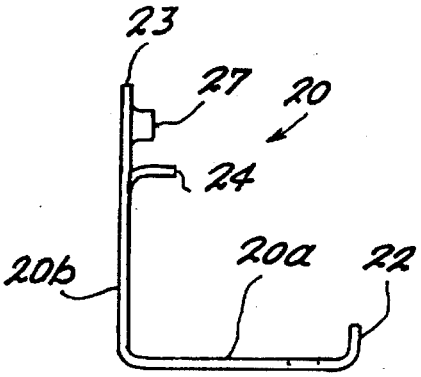
FIG. 7 is a side view of the bracket represented in FIG. 6.

The deck 11 is equipped with means for holding a cabinet 19, which is schematically represented in FIG. 1 by its frame, closed off by only two lateral panels. FIGS. 2, 4, and 5 illustrate details of the cabinet holding means. These means are formed by two brackets 20 which are removably fastened to the deck 11. FIGS. 6 and 7 illustrate an example of embodiment of a bracket 20. Each bracket 20 has the general shape of two fins **20*a*, 20*b* which form a right angle. The fin 20*a* is removably fastened onto the deck 11, for example by two screws 21 which turn inside tap nuts in the deck. It ends in a maneuvering flange 22. The fin 20*b* is extended by two lateral tabs 23 and by an intermediate tab 24 folded back into a position parallel to that of the fin 20*a*. In reference to FIGS. 4 and 5, the horizontal tube 19*a* which constitutes an element of the bottom part of the frame of the cabinet is intended to rest on the intermediate tab 24. In the example illustrated, the intermediate tabs 24 of the two brackets 20 can support the weight of the cabinet. In the example illustrated in FIGS. 4 and 5, the cabinet 19 has casters whose elevation is lower than the elevation of the intermediate tabs 24 relative to the deck 11. However, as illustrated in FIG. 5, the cabinet also rests on the deck by means of screw jacks 25 which are placed just to increase the cabinet's support area on the deck and to assure greater stability of the cabinet in case of shock. In order to reinforce this effect, the feet of the screw jacks 25 preferably rest in hollows 26 in the deck. The screw jacks 25 also have another role which will be described below. The lateral tabs 23 serve to immobilize the cabinet 19 in rotation and in transverse translation, and they have two respective pins 27 which fit into two corresponding holes provided in the frame member 19*a* to assure the immobilization of the cabinet in rotation and in longitudinal translation. Thus, the brackets illustrated play a triple role: They support the entire weight of the cabinet, they immobilize the cabinet in rotation and in translation and, in the case of a lateral shock, the absorb the energy of the shock by bending at the level of the tabs 24 and their fins 20*b***. However, it is clear that, in general, their role can essentially be limited to the immobilization of the cabinet. In other words, the cabinet could be completely or partially supported by its casters or other elements.

The depalletization of the cabinet 19 is accomplished as follows. The screw jacks 18 are maneuvered so that they lift the skids 12 slightly off the ground. The weight of the cabinet then rests on the deck 11, supported entirely on its screw jacks 18. The deck therefore has a very strong structure, formed for example by a thick wooden plank. The skids 12 are then removed by unscrewing the screws 16. Then, the screw jacks 18 are maneuvered in order to lower the deck and set it on the ground. The screw jacks 25 of the cabinet are then maneuvered in order to lift it slightly and to free the tabs 24 of the brackets 20 from the weight of the cabinet. Likewise, the brackets 20 can be removed by unscrewing the screws 21 which fasten the fin **20*a* to the deck 11 and by pivoting the brackets by means of the maneuvering flanges 22 so as to free the pins 27 from the frame of the cabinet. It is then sufficient to lower the cabinet by means of the screw jacks 25 in order to set its casters onto the deck. It is rolled up to the edge of the deck. The thickness of the deck, although relatively large, on the order of 30 mm for example, is acceptable for the lowering of the cabinet as long as the shock sustained in this drop falls within the prescribed range of tolerance. If not, the edges of the deck can be made thinner by being given a bevelled shape, or guide rails can be provided which would have the advantage of being simply small-sized wooden wedges for offsetting a drop on the order of 5 cm at most and of being able to rest entirely on the ground. This depalletization process is therefore very simple and can be easily carried out by only one person. Another advantage is that the release of the cabinet is done with the deck 11** resting on the ground, without any action on the case or housing of the cabinet (ground clearance on the order of 35 mm) or its protective sheath. There is no strain on the external case (housing) and design of the cabinet. Moreover, the deck support means and the holding means are very simple, not very costly, and very effective.

Figure 8:
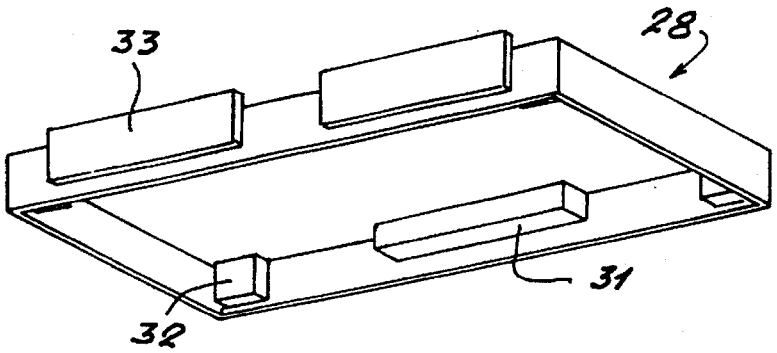
FIG. 8 is a perspective view from underneath the cover carried by the cabinet.

The cabinet holding means also include a cover 28 fastened to the top (roof) of the cabinet, which is represented in perspective from below in FIG. 8. In the example illustrated in FIG. 1, the top of the cabinet has been removed to reveal the frame. The top is normally placed beside the cabinet in a manner not illustrated in the drawings. The roof of the cabinet has, in its corners, four respective thick nuts 29 for screwing onto eye screws for lifting the cabinet by means of a lift bridge or a crane. The nuts 29 are used to attach two parallel boards 30, preferably perpendicular to the skids 12 which extend beyond each side of the cabinet by a given length. The boards 30 are used to support the cover 28. The cover is ordinarily made of cardboard or a similar material. It is edged on the sides of the cabinet with shock absorbing blocks 31 whose thickness roughly corresponds to the given length for the extension of the boards 30. This length gives the blocks sufficient thickness for good shock absorption. Foam blocks 32 are also provided at the four inside corners in order to compensate for the possible cabinet lengths and so that only one cover can be used for cabinets of different lengths. The cover 28 also includes external lateral foam blocks of slight thickness 33, provided in order to reinforce the shock absorption, particularly in the case of a transverse shock.

Generally, then, the subject of the invention is a pallet 10 for transporting a load 19, said pallet having a deck 11 and means for supporting the deck which include two skids 12 removably mounted under the deck and screw jacks 18 which make it possible to vary the height of the deck relative to the ground, the deck having a structure capable of supporting the weight of the load when it is carried by the screw jacks.

The preceding description suggests numerous variants to one skilled in the art. It is clear that the pallet can have several skids and that the deck can be made from a material other than wood. Preferably, each skid includes a base which rests on the ground and shock absorbing means, such as a foam block 14, which serve as a spacer between the deck and the base of the skid. The skid can have just one spacer disposed on a main part of the base or, as illustrated, several foam spacers, in the form of small cubes, for example, which can be separated so as to provide another access for the forks of transport machines. Other materials or structures can be used as shock absorbing means. It has also been seen in the example illustrated that the foam block is fastened between the base 13 of the skid and a small board 15 equipped with means for its removable fastener 16 to be fastened to the deck of the pallet, by screwing it on, for example. This option has the advantage of being simple and not very costly. In another advantageous option, the shock absorbing means 12 include a lateral board 17 fastened to the foam block and/or to the base of the skid, which serve to absorb horizontal shocks. Thus, this board absorbs transverse shocks more than longitudinal shocks. In an improved version, the external lateral board extends beyond the deck, for better absorption of longitudinal shocks.

There are numerous modes for holding the load on the pallet. In another characteristic of the invention, which can be independent from the preceding, but which advantageously complements it in solving the problem solved by the invention, the means for holding the load include two brackets 20 fastened removably to the deck and to the load. In the example described, each bracket has a general shape with two fins which form a right angle, with a first fin **20*a* removably mounted on the deck, by screwing for example, and a second fin 20*b* equipped with a tab 24 parallel to the first fin. Several modes of embodiment are known for immobilizing the cabinet in translation and in rotation. In a selected option, the second fin 20*b* is equipped with means for holding the load, such as pins 27 which fit into corresponding holes in the cabinet in the example illustrated, while it is noted that other forms of embodiment may be better adapted to the loads used. In another selected option, the second fin 20*b* is extended by two tabs 23 for immobilizing the load in translation and in rotation. In another option, in the case in which the load is equipped with screw jacks, the holding means include means for holding the feet of the screw jacks 25 on the deck. such as hollows 26** in the deck. In the example illustrated. the effects of all these options are combined in such a way as to obtain great effectiveness of the holding means while benefitting from great simplicity and a low production cost.

The depalletization process is also apparent from the preceding description. It essentially consists of lowering the deck and moving the load in horizontal translation. It is clear that the pallet according to the invention does not apply in cases in which the load cannot be lifted and can only be moved in horizontal translation. In order to lower the deck, the example illustrated makes use of screw jacks to remove the skids, support the deck in place of the skids, and lower the deck. In one possible variant, each skid could be retracted by being unfastened and pivoted it around an edge of the deck, by means of a hinge for example. The removability of the skids includes this instance as well, whose purpose is to release the skids in order to lower the deck. The lowering can be carried out until the deck rests on the ground, as illustrated, or until it reaches a level which is sufficient so that the movement of the load off the pallet will be tolerated adequately by the load, that is, without subjecting it to shocks which are detrimental or are below a given value. The movement of the load can be carried out by rolling, as illustrated, or by sliding. The illustrated process for the depalletization a load mounted on a pallet made of a deck which rests on skids therefore consists of releasing the skids by raising the deck, then lowering the deck and moving the load in horizontal translation. In the case in which the load is fastened to the pallet by means of the brackets 20, it has been seen that these brackets are removed before the deck is lowered. However, depending on the holding means used, the lowering of the deck can be independent from the unfastening or removal of these means.

We claim:

1. A pallet for transporting a load, comprising a deck, skid means for supporting said deck at a predetermined distance above a reference plane, said skid means being removably attached to the deck, screw jack means disposed on the deck and adjustable to operate between first and second states, said screw jack means operating in said first state when said skid means is removed from the deck, for supporting the deck and for varying the height of the deck relative to said reference plane, and said screw jack means operating in said second state when said skid means is attached to the deck, for having no contact with said reference plane.

2. The pallet according to claim 1, wherein each skid includes a base adapted to rest on the reference plane and a spacer between the deck and the base, said spacer being a shock absorber.

3. The pallet according to claim 2, wherein the spacer is a foam block attached between the base of the skid and a board removably fastened to the deck of the pallet.

4. The pallet according to claim 3, further including two brackets removably fastened to the deck for holding the load.

5. The pallet according to claim 4, wherein each bracket includes two fins forming a right angle, a first fin being removably mounted on the deck, and a second fin having a tab parallel to the first fin.

6. The pallet according to claim 5, wherein the second fin includes pins for holding the load fixed, said pins being adapted to fit into corresponding holes in the load.

7. The pallet according to claim 5, wherein the second fin includes two extending tabs for immobilizing the load in translation and in rotation.

8. The pallet according to claim 4, wherein the deck further includes hollows for receiving ends of screw jacks carried by the load for positioning the screw jacks of the load on the deck.

9. The pallet according to claim 3, further including a lateral board fastened to the foam block and the base for absorption of horizontal shocks.

10. The pallet according to claim 9, further including two brackets removably fastened to the deck for holding the load.

11. The pallet according to claim 10, wherein each bracket includes two fins forming a right angle, a first fin being removably mounted on the deck, and a second fin having a tab parallel to the first fin.

12. The pallet according to claim 11, wherein the second fin includes pins for holding the load fixed, said pins being adapted to fit into corresponding holes in the load.

13. The pallet according to claim 12, wherein the second fin includes two tabs for immobilizing the load in translation and in rotation.

14. The pallet according to claim 10, wherein, the deck further includes hollows for receiving ends of screw jacks carried by the load for positioning the screw jacks of the load on the deck.

15. The pallet according to claim 2, further including a lateral board fastened to the spacer and the base of each skid for absorption of horizontal shocks.

16. The pallet according to claim 15, further including two brackets removably fastened to the deck for holding the load.

17. The pallet according to claim 16, wherein each bracket includes two fins forming a right angle, a first fin being removably mounted on the deck, and a second fin having a tab parallel to the first fin.

18. The pallet according to claim 17, wherein the second fin includes pins for holding the load fixed, said pins being adapted to fit into corresponding holes in the load.

19. The pallet according to claim 18, wherein the second fin includes two tabs for immobilizing the load in translation and in rotation.

20. The pallet according to claim 16, wherein, the deck further includes hollows for receiving ends of screw jacks carried by the load for positioning the screw jacks of the load on the deck.

21. The pallet according to claim 2, further including two spaced brackets removably fastened to the deck for holding the load.

22. The pallet according to claim 21, wherein each bracket includes two fins forming a right angle, a first fin being removably mounted on the deck, and a second fin having a tab parallel to the first fin.

23. The pallet according to claim 22, wherein the second fin includes pins for holding the load fixed, said pins adapted to fit into corresponding holes in the load.

24. The pallet according to claim 23, wherein the second fin includes two tabs for immobilizing the load in translation and in rotation.

25. The pallet according to claim 21, wherein the deck further includes hollows for receiving ends of screw jacks carried by the load for positioning the screw jacks of the load on the deck.

26. The pallet according to claim 1, further including two spaced brackets removably fastened to the deck for holding the load.

27. The pallet according to claim 26, wherein each bracket includes two fins forming a right angle, a first fin being removably mounted on the deck, and a second fin having a tab parallel to the first fin.

28. The pallet according to claim 27, wherein the second fin includes pins for holding the load fixed, said pins being adapted to fit into corresponding holes in the load.

29. The pallet according to claim 28, wherein the second fin includes two extending tabs for immobilizing the load in translation and in rotation.

30. The pallet according to claim 26, wherein the deck further includes hollows for receiving ends of screw jacks carried by the load for positioning the screw jacks of the load on the deck.

* * * * *

UNITED STATES PATENT AND TRADEMARK OFFICE

CERTIFICATE OF CORRECTION

PATENT NO. : 5,644,991

DATED : July 8, 1997

INVENTOR(S) : Jean-Paul PREVOT, et al

It is certified that error appears in the above-indentified patent and that said Letters Patent is hereby corrected as shown below:

Title page, item

[57] In the abstract, last sentence, delete "invention applies most particularly" and insert --pallet has particular application--.

Column 6, line 42 (Claim 7, line 2), delete "extending".

Signed and Sealed this

Tenth Day of February, 1998

*Attest:*

*Attesting Officer*

BRUCE LEHMAN

*Commissioner of Patents and Trademarks*